United States Patent [19]

Kemnitz

[11] 4,106,707

[45] Aug. 15, 1978

[54] FEED DISTRIBUTOR FOR GYRATORY CRUSHER

[75] Inventor: Robert H. Kemnitz, Appleton, Wis.

[73] Assignee: Allis-Chalmers Corporation, Milwaukee, Wis.

[21] Appl. No.: 807,559

[22] Filed: Jun. 17, 1977

[51] Int. Cl.[2] ..... B02C 2/06

[52] U.S. Cl. ..... 241/202

[58] Field of Search ..... 241/202, 207–216

[56] References Cited

U.S. PATENT DOCUMENTS

| | | | |
|---|---|---|---|
| 1,920,488 | 8/1933 | Symons | 241/202 |
| 2,656,120 | 10/1953 | Roubal | 241/209 X |
| 3,212,720 | 10/1965 | Gasparac et al. | 241/202 X |
| 3,785,578 | 1/1974 | Kemnitz | 241/202 |
| 3,813,046 | 5/1974 | Kemnitz et al. | 241/202 |
| 3,957,213 | 5/1976 | Stockman et al. | 241/202 |

*Primary Examiner*—Howard N. Goldberg
*Attorney, Agent, or Firm*—Robert C. Jones

[57] ABSTRACT

A feeder distributor is mounted above an annular crushing chamber of a gyratory crusher and operates to distribute feed uniformly around the entire circumference rather than at one revolving point. A rotating cylinder has a rotating bottom plate of larger diameter connected to it by ribs leaving a circumferential opening between the cylinder and the plate. The circumferential opening is sized to prevent the flow of material when the cylinder and plate are not rotating. When rotating, the material is thrown off of the plate around the entire circumference of the plate by centrifugal force. This provides good continuous distribution of material around the entire crusher chamber regardless of the feed rate into the cylinder.

7 Claims, 4 Drawing Figures

10
12
14
16
17
20
21
22
23
24
26
27
28
29
31
40
42
43
44
46
47
48
49
51
52
54
56
62
63
64
66
68
71
72
73
74
75
76
77
82
84
86
91
92
S
X
II 128
127
5
112
111
116
86
129
IV
119
121
123
122
114
118
117
82
84
107
108
118
119
114
119
123

111
106
117
104
112
111
100
131
116
P
IV
115
121
123
119
S
108
86

FEED DISTRIBUTOR FOR GYRATORY CRUSHER

BACKGROUND OF THE INVENTION

1. Field of the Invention

This invention relates to rock crushing machines having a conical head and a surrounding shell that defines therebetween an annular crushing chamber, and in particular to such a machine having a feed distributor for evenly discharging feed to the annular crushing chamber. More particularly, this invention is an improvement to the feed distributing arrangement disclosed in U.S. Pat. No. 3,785,578.

2. Description of the Prior Art

Crushers known to the prior art which include feed distributing devices are of various types.

One type involves transmitting the motion of a crushing cone, or the motion transmitted to a crushing cone, through gears or pulleys, to a feed distributor over the annular crushing chamber. By the selection of gear or pulley sizes and design of the gear train the feed distributor may be made to turn at a selected speed which may be faster or slower than the drive turns the cone or an eccentric bearing around the cone shaft. A feed distributor of this type is shown in U.S. Pat. No. 475,330. More modern versions of such a feed distributor are shown in, for example, U.S. Pat. Nos. 2,621,860 and 2,917,247.

Another type provides a feed distributing cone pan or plate resiliently mounted above the crushing chamber and flexibly connected to the crushing cone so the turning or gyrating motion of the crushing cone causes the feed distributor to wobble and this motion is utilized to distribute feed material around the annular crushing chamber. Such a feed distributor is shown in U.S. Pat. Nos. 1,761,240; 2,586,122 and 2,656,120.

Neither of the first two types of the prior art have any provision for adjusting the speed of operation of the feed distributor while the crusher was in operation and independent of the rate of gyration or rotation of the crushing head. Still another type has one or more drive motors separate and independent of the crusher drive. The feed distributor of this type can be adjusted to operate at selected rates independent of the rate of gyration or rotation of the crusher head. U.S. Pat. Nos. 2,737,289; 3,212,720; 3,358,939; 3,384,215 and 3,565,353 are illustrative of this type of crusher. In such machines force is applied to the feed material to move the feed in a generally horizontal plane to a location over the crushing chamber where gravity is relied upon to direct the material between the cone and the surrounding shell structure.

A further type is exemplified in U.S. Pat. Nos. 3,506,203 and 3,604,636, which disclose feed distributors that direct a flow of feed material around an annular crushing chamber and down an inclined path.

Still another type of material distributor is of the rock and roll type and is connected to move with the crusher head thereby taking part of the gyratory movement of the crusher head. This type of distributor has the disadvantage of being dependent at the rate at which the material is fed to the distributor. Variations in the feed causes a variation in the manner in which the material is distributed to the crushing chamber, the material sometimes being heavy and sometimes light. U.S. Pat. Nos. 2,207,858; 2,656,120 and 3,614,023 are of this type.

SUMMARY OF THE INVENTION

It is an object of the present invention to provide a new and improved material feed distributor for crushers that may be preassembled as a single unitary assembly that may be simply and easily mounted on a crusher and removed therefrom as a unit providing clear access to the interior of the crusher.

According to a preferred embodiment of the present invention, the complete material feed distributor is removably mounted on the frame above the annular crushing chamber of a gyratory crusher. A cylindrical material enclosure is provided with an inwardly extending annular flange at its lower end which is adapted to be removably attached to the crusher frame. A plurality of arms project radially inwardly away from the enclosure wall to support a platform centrally located within the material enclosure. A circular material distributor plate is supported on the platform by means of a tubular pillar for rotation about a vertical axis which is centrally disposed with respect to the material feed enclosure and the annular crushing chamber. The circular material distributor plate extends radially outwardly of the lower peripheral edge of a cylindrical feed bin which is in the form of a frustum of a cone. The feed bin is connected to the distributor plate by spaced vertical ribs which arrangement provides a circumferential opening between the bottom of the feed bin and the distributor plate. The opening is sized to prevent material flow when the distributor plate is not rotating. A feed hopper is supported by the material feed enclosure over the conical bin and is provided with a discharge spout coaxial with the vertical axis about which the distributor plate and frusto-conical bin rotate. A driving motor is supported by the material feed enclosure and is drivingly connected to the conical bin to rotate it and the distributor plate in a horizontal plane above the annular crushing chamber to discharge the material falling through from the discharge spout and through the conical bin through the circumferential opening outwardly from the peripheral edge of the distributor plate into and all around the annular crushing chamber. The feed distributor provides uniform material feed around the entire circumference of the distributor plate and excellent distribution around the annular crushing chamber.

DESCRIPTION OF THE INVENTION

Figures 1, 2:
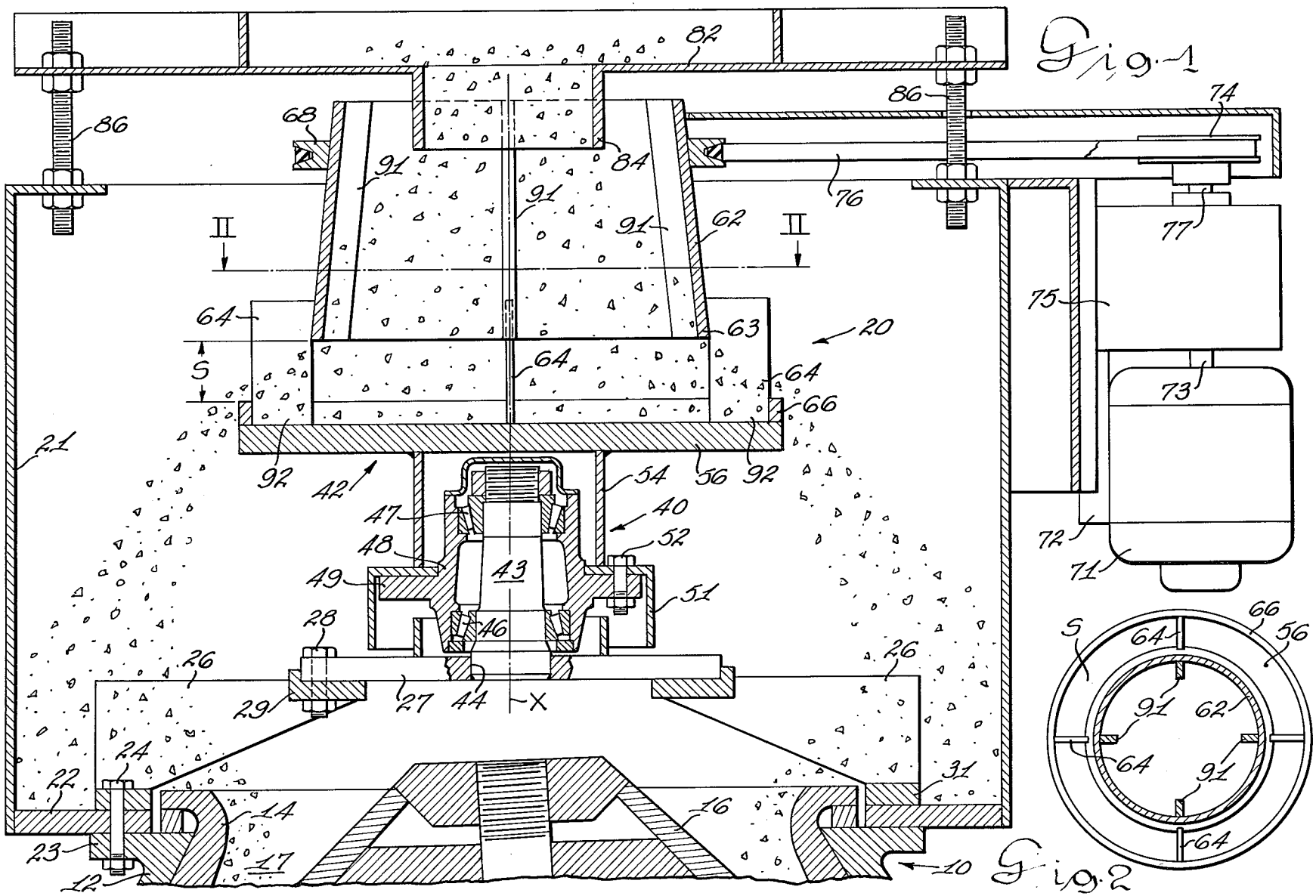
FIG. 1 is a fragmentary section view partly in elevation of a gyratory crusher in which the present invention has been incorporated.
FIG. 2 is a view in horizontal section taken in a plane represented by the line II—II in FIG. 1.

Referring to the drawings, an upper portion of a gyratory crusher 10 is shown. The crusher 10 includes a frame top shell 12, an annular bowl 14 arranged within shell 12, and a conical crushing head 16 within bowl 14. The crushing head 16 and bowl 14 cooperate to define an annular crushing chamber 17.

A material feed distributor 20 is mounted on top of the frame top shell 12 and over the annular crushing chamber 17. The distributor 20 has a cylindrical feed enclosure 21 with an inwardly projecting annular flange 22 at the lower end of the enclosure 21. The annular flange 22 is adapted to seat on an annular flange 23 formed around the top of the frame top shell 12 and is secured thereto by a plurality of bolts 24.

A plurality of arm members 26 project radially inwardly of the enclosure 21 to support a platform 27 which is secured to the arm members by bolts 28. To this purpose, the inner ends of each of the arm members 26 have a plate 29 welded to their inner ends which plates serve as a rigid base for platform 27. The arms 26 rest upon the annular flange 22 with the bolts 24 passing through a flange 31 welded to each arm member 26 before passing through enclosure flange 22 and the top shell flange 23. Thus, the same bolts 24 which serve to connect the arm members to the flange 22 will also secure the entire distributor 20 to the crusher top shell 12.

A support 40 mounted on platform 27, includes a rotating assembly 42 for rotation about a vertical axis X centrally located in relation to the material feed enclosure 21, bowl 14 and crushing chamber 17.

The support 40 includes an upright post 43 connected to the platform 27 as being welded in an opening 44 formed in platform 27 the axis of which coincides with the axis X. Bearings 46 and 47 mounted around post 43 rotatably support a hub 48. The hub 48 has a radially outwardly extending flange 49.

The rotating distributor assembly 42 comprises an annular collar 51 that is disposed on top of the hub flange 49 and is secured thereto by a plurality of bolts 52. An upright tubular support 54 is secured, as by being welded to the top of the collar 51 and in coaxial relationship to the post 43 and hub 49. The tubular support 54 receives a circular material distributor plate 56 which is coaxially arranged with the axis X. A frusto conical material feed bin 62 is connected to the plate 56. This is accomplished by welding the bottom or base portion 63 of the frusto conical bin 62 to the upper inner edge portions of a plurality of upstanding spaced apart ribs 64. The ribs 64 are individually secured to the top surface of the distributor plate 56 being rigidly reinforced by operation of a circular collar portion 66 to which the ribs are welded. The circular collar 66 is welded to the distributor plate 56. With this arrangement, a circumferential opening S is formed between the base 63 of the frusto conical bin 62 and the top of the distributor plate 56. A sheave 68 is secured around the circumference of the frusto conical bin 62 by suitable means such as welding. A motor 71 is mounted on the outer surface of the material feed enclosure 21 by means of a bracket 72. The motor drive shaft 73 is connected to drive a variable speed device 75 also secured to the exterior of the enclosure 21. A sheave 74 is secured to the extending end of the variable speed device output shaft 77. Thus, the rotating speed can be changed via the variable speed drive 75 to change the discharge rate of the distributor to the optimum rate. An endless belt 76 is entrained around sheave 68 and 74 to effect rotational movement of the frusto conical bin 62 and thereby the distributor plate 56.

A feed hopper 82 having a discharge spout 84 depending therefrom is arranged so that the discharge spout 84 projects downwardly discharging into the frusto conical bin 62; the axis of spout 84 being coaxial with the bin 62. Hopper 82 is mounted on top of the cylindrical enclosure 21 by means of a plurality of bolts 86.

Internally within the frusto conical bin 62 are a plurality of vertically arranged fins or vanes 91. Thus, feed material discharged from the hopper 82 into the bin 62 will be rotated with the frusto conical bin 62 and the distributor plate 56. The bottom portions 92 of the ribs 64 will promote the rotation of the material on the distributor plate 56. This arrangement has been found to prevent slippage of the material relative to the bin and plate thereby preventing undue wear on the bin and plate.

In the preferred embodiment of the invention herein disclosed, the material feed bin 62 has been disclosed as a frustum of a cone. This construction promotes the downward flow of the feed material to the distributor plate 56. The diverging wall of the bin 62 causes a downward force to develop which tends to overcome any resistance to movement that may be caused by friction between the feed material particles. However, it is contemplated that the bin 62 may be formed as a cylinder if so desired.

The material moving downwardly through the frusto conical bin 62 onto the distributor plate 56 is spread evenly over the plate surface. When the unit is rotating, the material will be thrown off of the plate around its entire circumference by centrifugal force. A continuous supply of material will always be available on the plate to replace the material thrown from the plate. Thus, there will be continuous material distribution around the entire annular crushing chamber regardless of the feed rate into the frusto conical bin.

The circumferential opening or space S is sized so as to prevent the flow of material when the distributor plate 56 and the material bin 62 are not rotating. This prevents clogging of the crushing chamber from an overfill when crushing is not being accomplished. When crushing is being accomplished, the material is fed into the crushing chamber under controlled conditions evenly and uniformly around the entire circumference of the chamber. The arrangement herein set forth is the antithesis of the prior art wherein material is spot fed into the crushing chamber at changing locations which are relatively small when compared to the circumference of the annular crushing chamber.

Figures 3, 4:
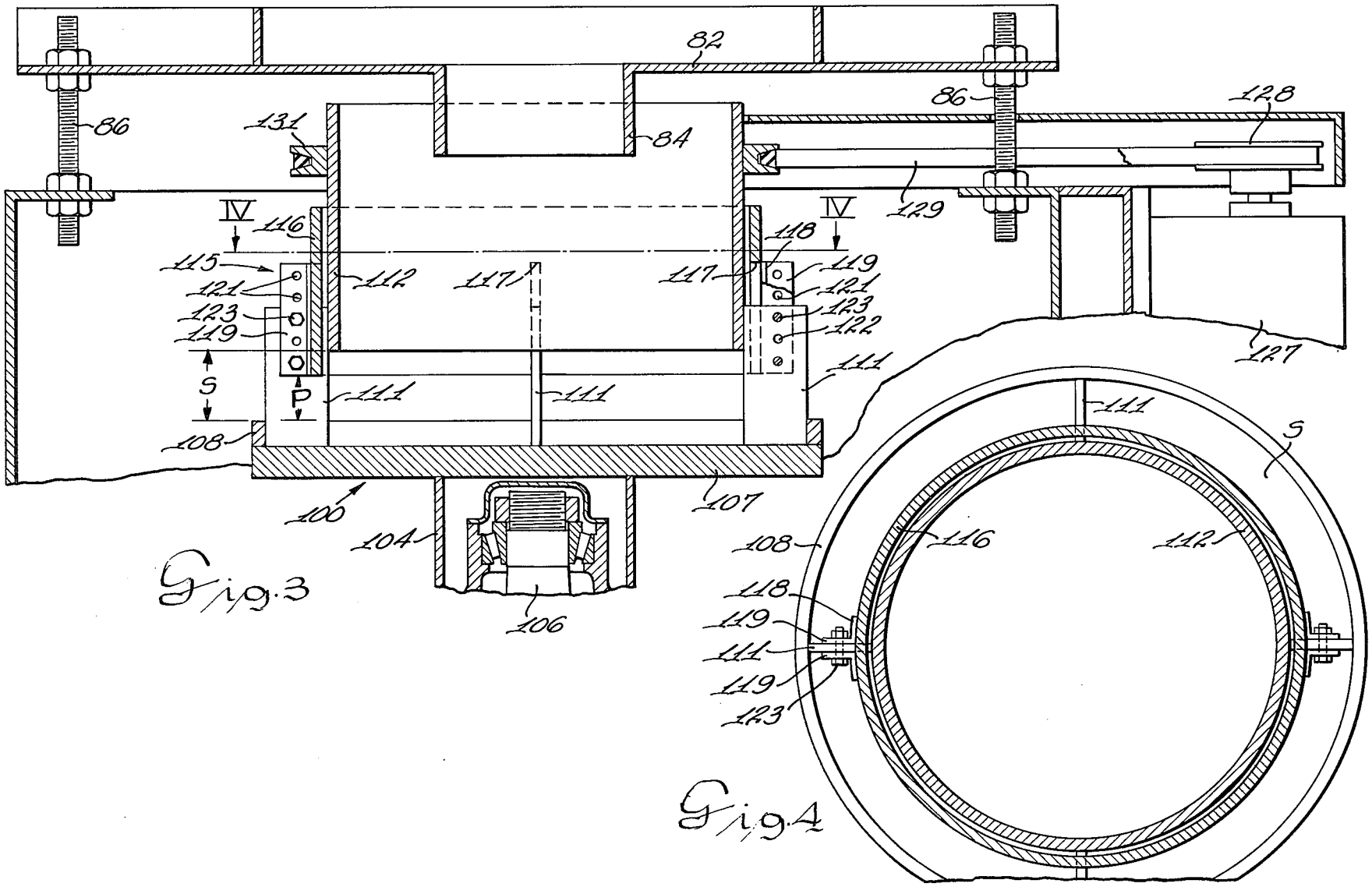
FIG. 3 is a view similar to FIG. 1 showing a modified form of the invention in which the material bin is vertically adjustable; and, FIG. 4 is a view in horizontal section taken in a plane represented by the line IV—IV in FIG. 3.

A modified arrangement of the distributor is shown in FIG. 3. The rotating distributor assembly 100 is mounted over the annular crusher chamber as previously described, and includes a support 104 which is mounted for rotation on a stationary post 106. A distributor plate 107 having an annular upstanding flange portion 108. Upstanding from the top surface of plate 107 are a plurality of spaced apart support ribs 111. A cylindrical feed bin 112 is connected to the plate 107 by being welded to the support ribs 111. The arrangement is such that the space S that is formed between the top surface of the flange portion 108 and the base edge of the cylindrical bin 112 is sufficiently large to accommodate the largest size of material contemplated to be crushed. However, to increase the usability of the distributor so as to handle a large range of material from the largest to the smallest size an adjustable feed control means 115 is provided. To this purpose the feed control means 115 comprises a cylindrical sleeve 116 which is freely fitted around the cylindrical bin 112. Vertical slots 117 are provided in the cylindrical sleeve 116 and are spaced in accordance with the spacing of the ribs 111. Thus, the sleeve 116 is vertically movable with respect to the bin portion 112 with the slots 117 accommodating the vertical ribs 111. As shown in FIG. 4, vertical angles 118 are welded or otherwise secured to the external surface of the sleeve. The radial extending legs 119 of the angles 118 are each provided with openings 121 and are selectively alignable with any one of a plurality of vertically spaced complementary openings 122 formed in the ribs 111. Bolts 123 pass through the aligned openings 121 and 122 of the legs 119 and ribs 111, respectively, to secure the sleeve in an adjusted position relative to the top surface of the flange 108. Thus, the size of the opening P between the bottom edge of the sleeve 116 and the top surface of the flange 108 can be adjusted so as to provide the optimum distribution of the size of material to be distributed.

Rotation of the distributor is effected in the manner set forth with the device of FIG. 1, that is, an electric motor (not shown) driving through a variable speed device 127. The output shaft of the variable speed device 127 is provided with a sheave 128 connected by an endless belt 129 to another sheave 131 welded to the exterior of the cylindrical bin 112.

With the arrangement, the space P can be changed to accommodate different sizes of material feed or change feed rates or compensate for variation in the moisture content of the feed. Through operation of the variable speed device 127 the rotating speed of the distributor can be varied to accommodate the different feed rates.

Under spot feeding condition, when the feed rate is low, crushing occurs only where the feed is entering the crushing chamber and the remainder of the chamber is not working.

The embodiments of the invention in which an exclusive property or privilege is claimed are defined as follows:

1. In a crusher having a frame which supports a crusher mantle head for gyratory movement and a stationary concave surrounding the crusher mantle, the mantle and concave defining an annular crushing chamber therebetween, a feed distributor comprising:

support means carried by the frame;

a circular material distributor plate carried by said support means for rotation independently of the movement of the crusher head;

a frusto conical material bin having an opening therethrough supported by said distributor plate in coaxial relationship above the surface thereof and positioned to define a circumferential opening between the bottom of the bin and the top surface of the distributor plate;

a material hopper means supported above said frusto conical material bin, said hopper having a discharge spout coaxial with said bin for supplying material to said bin; and, power drive means operably connected to effect the simultaneous rotation of said material bin and said distributor plate;

whereby the material fed to the distributor plate from said bin will flow radially outwardly from the circumferential opening and be distributed by centrifugal force evenly around the entire crushing chamber.

2. A crusher according to claim 1 wherein the interior of said frusto conical material bin is provided with a plurality of spaced apart vanes which serve to enforce rotational movement of material in said bin with the rotation of said bin.

3. A crusher according to claim 2 in which said frusto conical material bin is supported in elevated relationship with respect to the top surface of said circular distributor plate to define a circumferential opening sized to prevent the flow of material therefrom when said distributor plate and said material bin are not rotating.

4. A crusher according to claim 2 in which said frusto conical material bin is supported in elevated relationship with respect to the top surface of said circular distributor plate by a plurality of spaced apart ribs that are secured to said distributor plate.

5. A crusher according to claim 4 wherein the diameter of the base of said frusto conical material bin is smaller in diameter than the diameter of said distributor plate.

6. In a crusher having a frame which supports a crusher mantle for gyratory movement within a stationary concave, said mantle and concave defining a crushing chamber;

a support means carried by the frame;

a circular feed distributor plate carried by said support means for rotation about a vertical axis which coincides with the axis of the crushing chamber;

a hollow cylindrical material feed bin supported by said distributor plate in coaxial relationship therewith and positioned above the surface of said distributor plate to define a circumferential opening between the surface of the distributor plate and the bottom edge of said hollow cylindrical bin;

regulating means associated with said hollow cylindrical bin for adjusting the size of the circumferential opening between said distributor plate and the bottom edge of said hollow cylindrical feed bin to accommodate the size of material feed being processed; and power drive means connected to rotate said distributor plate, said cylindrical feed bin and said regulating means in unison.

7. A crusher according to claim 6 wherein said regulating means includes a positionable sleeve surrounding said hollow cylindrical bin in coaxial relationship therewith;

securing means to secure said sleeve in a selected axial position relative to said hollow cylindrical bin to regulate the size of the circumferential opening between the top surface of said distributor plate and the adjacent bottom edge of said hollow cylindrical bin to a predetermined size according to the feed material being processed.

* * * * *